US007513605B2

(12) United States Patent
Min et al.

(10) Patent No.: US 7,513,605 B2
(45) Date of Patent: Apr. 7, 2009

(54) INKJET PRINTHEAD WITH HEAT GENERATING RESISTOR

(75) Inventors: Jae-sik Min, Suwon-si (KR); Young-ung Ha, Suwon-si (KR); Byung-ha Park, Suwon-si (KR); Myong-jong Kwon, Suwon-si (KR); Kyong-il Kim, Seoul (KR); Yong-shik Park, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 360 days.

(21) Appl. No.: 11/379,126

(22) Filed: Apr. 18, 2006

(65) Prior Publication Data

US 2006/0232635 A1 Oct. 19, 2006

(30) Foreign Application Priority Data

Apr. 18, 2005 (KR) ..... 10-2005-0031930

(51) Int. Cl.
*B41J 2/05* (2006.01)

(52) U.S. Cl. ..... 347/56; 347/62

(58) Field of Classification Search ..... 347/20, 347/56, 61–65, 67

See application file for complete search history.

(56) References Cited

U.S. PATENT DOCUMENTS

| | | | | |
|---|---|---|---|---|
| 5,660,739 | A * | 8/1997 | Ozaki et al. | 347/62 |
| 5,870,121 | A * | 2/1999 | Chan | 347/59 |
| 6,382,782 | B1 | 5/2002 | Anagnostopoulos et al. | 347/82 |
| 6,491,376 | B2 | 12/2002 | Trauernicht et al. | 347/47 |
| 2003/0234833 | A1 | 12/2003 | Kim | 347/62 |
| 2004/0119788 | A1 | 6/2004 | Beak | 347/58 |
| 2004/0155930 | A1 | 8/2004 | Cho et al. | 347/56 |
| 2006/0044347 | A1 * | 3/2006 | Kwon et al. | 347/44 |

FOREIGN PATENT DOCUMENTS

| | | | |
|---|---|---|---|
| JP | 62-259469 | * | 11/1987 |
| JP | 2003151730 A | * | 5/2003 |
| KR | 2003-35236 | | 5/2003 |
| KR | 2003-97326 | | 12/2003 |
| KR | 2004-43640 | | 5/2004 |
| KR | 2004-54432 | | 6/2004 |

* cited by examiner

*Primary Examiner*—Juanita D Stephens
(74) *Attorney, Agent, or Firm*—Stanzione & Kim, LLP

(57) ABSTRACT

An inkjet printhead includes a substrate having an ink chamber which is filled with ink to be ejected, a nozzle plate formed on the substrate in a position corresponding to the ink chamber, and a heat generating resistor installed in the ink chamber and formed of $TiN_x$, where x ranges from 0.2 to 0.5, to generate ink bubbles in the ink by generating heat.

20 Claims, 7 Drawing Sheets

INKJET PRINTHEAD WITH HEAT GENERATING RESISTOR

CROSS-REFERENCE TO RELATED APPLICATIONS

This application claims the benefit under 35 U.S.C. § 119 of Korean Patent Application No. 2005-31930, filed on Apr. 18, 2005, in the Korean Intellectual Property Office, the disclosure of which is incorporated herein in its entirety.

BACKGROUND OF THE INVENTION

1. Field of the Invention

The present general inventive concept relates to an inkjet printhead, and more particularly, to an inkjet printhead including a heat generating resistor made of a titanium nitride compound $TiN_{0.3}$.

2. Description of the Related Art

Ink ejection mechanisms used in inkjet printers are largely categorized into two different types: an electro-thermal transducer type (bubble-jet type) in which a heat source is employed to form bubbles in ink causing the ink to be ejected, and an electro-mechanical transducer type in which ink is ejected as a result of a change in volume due to deformation of a piezoelectric element.

In the electro-thermal transducer, heat is delivered to the ink that contacts a heater, and the temperature of the ink, which is a water-based fluid, increases rapidly above a boiling point. When the temperature of the ink increases above the boiling point, ink bubbles are generated in the ink and the ink bubbles increase pressure of the ink. The pressurized ink is ejected through a nozzle due to a pressure difference between the atmospheric pressure and the pressure of the ink. The ink is ejected onto a surface of a printing paper, in the form of ink droplets, which minimize a surface energy of the ejected ink. This process may be controlled by a computer and is known as a Drop-on-Demand method.

However, such electro-thermal transducers have a durability problem due to the repeated thermal shocks caused by heating the ink and the pressure of the ink bubbles occurring in the heated ink, and it is difficult to control the size of the ejected ink droplets and to increase the printing speed.

Recently, due to demand of high speed and high accumulation printing, an arrayhead and a linehead including a printhead corresponding to the width of a printing paper have been developed.

For inkjet printers having such an arrayhead or a linehead, a highly efficient heat source is required to reduce a driving power thereof. To increase the efficiency of the heat source, it is desirable to eliminate a heat source protection layer, which is disposed on the heat source between the heater and the ink and is provided for electrical insulation. The heat source protection layer itself has a low thermal conductivity and thus becomes an obstacle when trying to reduce the driving power.

A heat source that is not protected by the heat source protection layer and contacts the ink directly should satisfy the following two conditions. First, as the heat source directly contacts the ink and operates at a high temperature, the heat source may easily corrode. Therefore, the heat source should be made of a strong corrosion-resistant material. Second, because the heat source should directly handle cavitation, which occurs when bubbles are formed and then collapse, the heat source needs to be resistant to a cavitation force.

SUMMARY OF THE INVENTION

The present general inventive concept provides an inkjet printhead with a heat generating resistor formed of $TiN_{0.3}$, which is greatly resistant to ink corrosion at a high temperature and to a cavitation force, in order to reduce a driving power.

Additional aspects and advantages of the present general inventive concept will be set forth in part in the description which follows and, in part, will be obvious from the description, or may be learned by practice of the general inventive concept.

The foregoing and/or other aspects of the present general inventive concept are achieved by providing an inkjet printhead including a substrate having an ink chamber which is filled with ink to be ejected, a nozzle plate which is formed on the substrate in a position corresponding to the ink chamber, and a heat generating resistor formed in the ink chamber to generate bubbles in the ink by generating heat, the heat generating resistor being formed of titanium nitride $TiN_x$, where x ranges from 0.2 to 0.5.

The heat generating resistor may be formed of $TiN_{0.3}$.

The foregoing and/or other aspects of the present general inventive concept are also achieved by providing an inkjet printhead including a substrate having a plurality on nozzles to eject ink, and a plurality of nozzle units formed between the substrate and the nozzle plate corresponding to the plurality of nozzles, each of the plurality of nozzles units including an ink chamber filled with ink to be ejected through the corresponding nozzle from the plurality of nozzles, and a heat generating resistor disposed in the ink chamber opposite to the corresponding nozzle to heat the ink when connected to a power supply, the heat generating resistor being made of $TiN_x$, where x is in a range of between 0.2 and 0.5.

The foregoing and/or other aspects of the present general inventive concept are also achieved by providing a method of ejecting in an inkjet printhead having a plurality of nozzles connected to corresponding ink chambers, the method including heating ink in the ink chambers above a boiling temperature using corresponding heat generating resistors made of a $TiN_x$ compound, where x is in a range of between 0.2 and 0.5.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
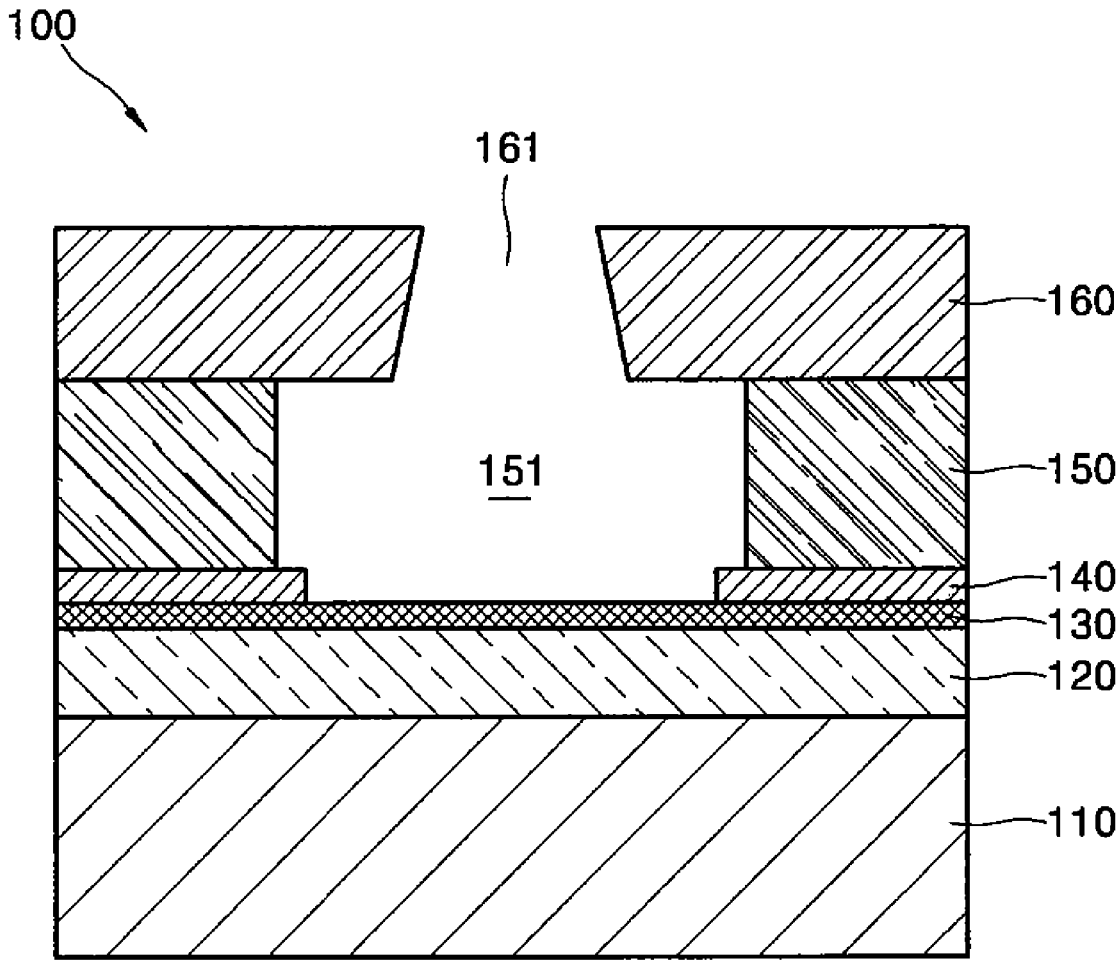
FIG. 1 is a cross-sectional view schematically illustrating a structure of an inkjet printhead with a heat generating resistor according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a cross-sectional view schematically illustrating a structure of an inkjet printhead 100 which includes a heat generating resistor.

Referring to FIG. 1, the inkjet printhead 100 includes a substrate 110, a heat generating resistor 130, an ink chamber 151, and a nozzle plate 160.

A substrate isolating layer 120 is provided on the substrate 110 to isolate the substrate 110 from the heat generating resistor 130.

The ink chamber 151 is surrounded by barriers 150 formed on the substrate 110, and the ink supplied through an ink inlet gate (not shown) fills the ink chamber 151.

The heat generating resistor 130 is provided on the substrate isolating layer 120 below the ink chamber 151. The heat generating resistor 130 generates heat, and the heat forms ink bubbles, and thus the volume of the ink in the ink chamber 151 changes so that the ink is ejected outside the ink chamber 151. The heat generating resistor 130 is connected by electrodes 140 provided thereon to an external power source (not shown) to thus receive electric power.

The nozzle plate 160 is formed on an upper part of the ink chamber 151, and a nozzle 161 is provided through which the ink containing ink bubbles formed by the heat generating resistor 130 can be ejected outside the ink chamber 151.

The heat generating resistor 130 is formed of $TiN_x$, where x is in the range of 0.2 to 0.5 (corresponding to $TiN_{0.2}$ and $TiN_{0.5}$). Specifically, the heat generating resistor 130 can be made of $TiN_{0.3}$ (the composition ratio of Ti:N=1:0.2).

A crystalline structure of the heat generating resistor 130 may be a hexagonal lattice structure.

The specific resistance of the heat generating resistor 130 is in the range of 400 μΩcm through 500 μΩcm, for example, the specific resistance may be about 400 μΩ cm. A thickness of the heat generating resistor 130 may be in the range of 500 Å through 5000 Å.

Table 1 below illustrates a comparison between the physical features of the heat generating resistor 130 made of $TiN_{0.3}$ and the physical features of TiN (the composition ratio of Ti:N=1:1).

TABLE 1

| Item | $TiN_{0.3}$ | TiN | Remarks |
|---|---|---|---|
| Resistance [Ω] | 54 | 41 | |
| Intensity [$GW/m^2$] | 5.5 | 2.3 | |
| SST limit input energy [μJ] | 0.49 | 0.27 | Refer to FIG. 2 |
| Life span [ejected dots] | 5.64E+8 | 0 | Refer to FIG. 3 |
| Thickness [Å] | 3,000 | 3,000 | |

TABLE 1-continued

Figure 4A:
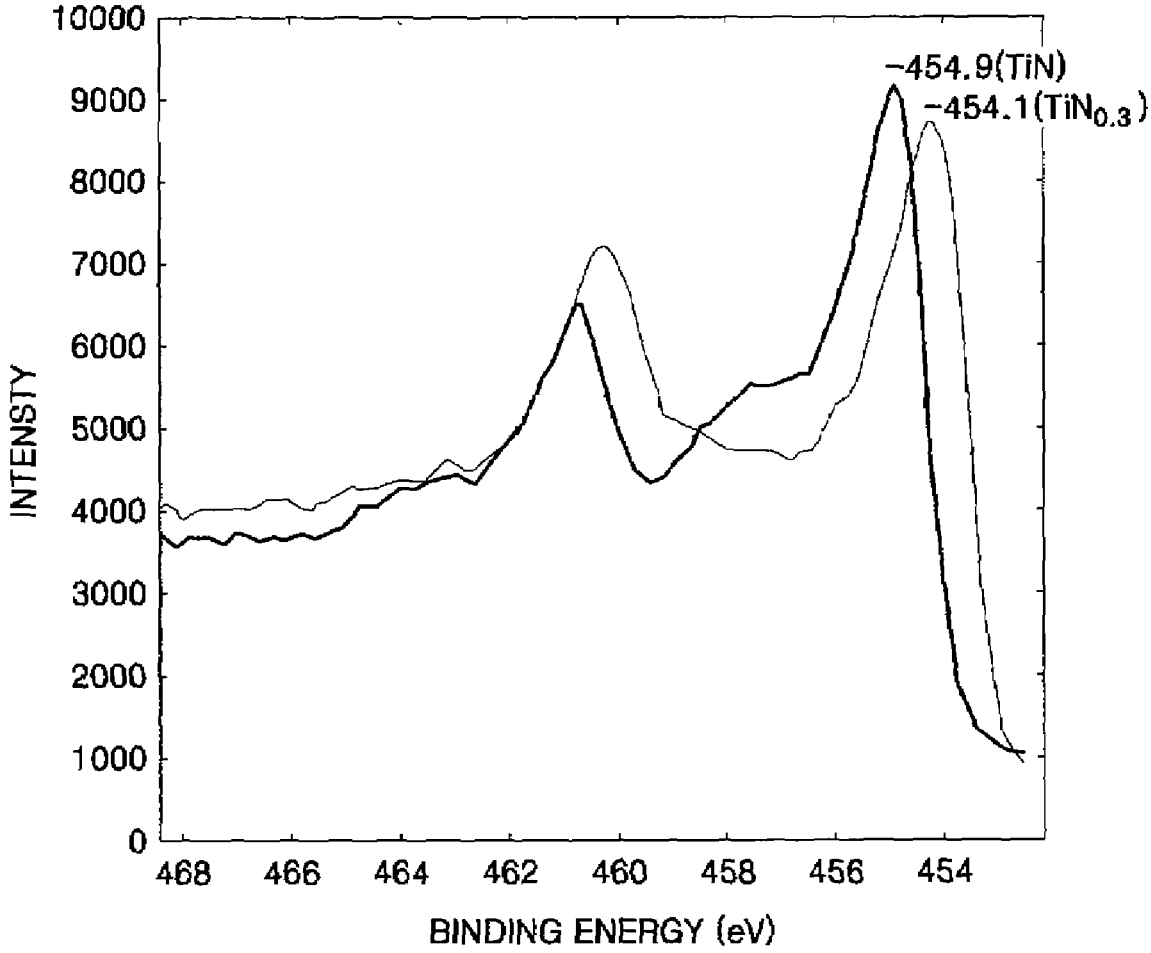
FIGS. 4A and 4B illustrate the results of analyzing composition ratios of the heat generating resistors made of $TiN_{0.3}$ and TiN using X-ray Photoelectron Spectroscopy (XPS)
Figure 4B:
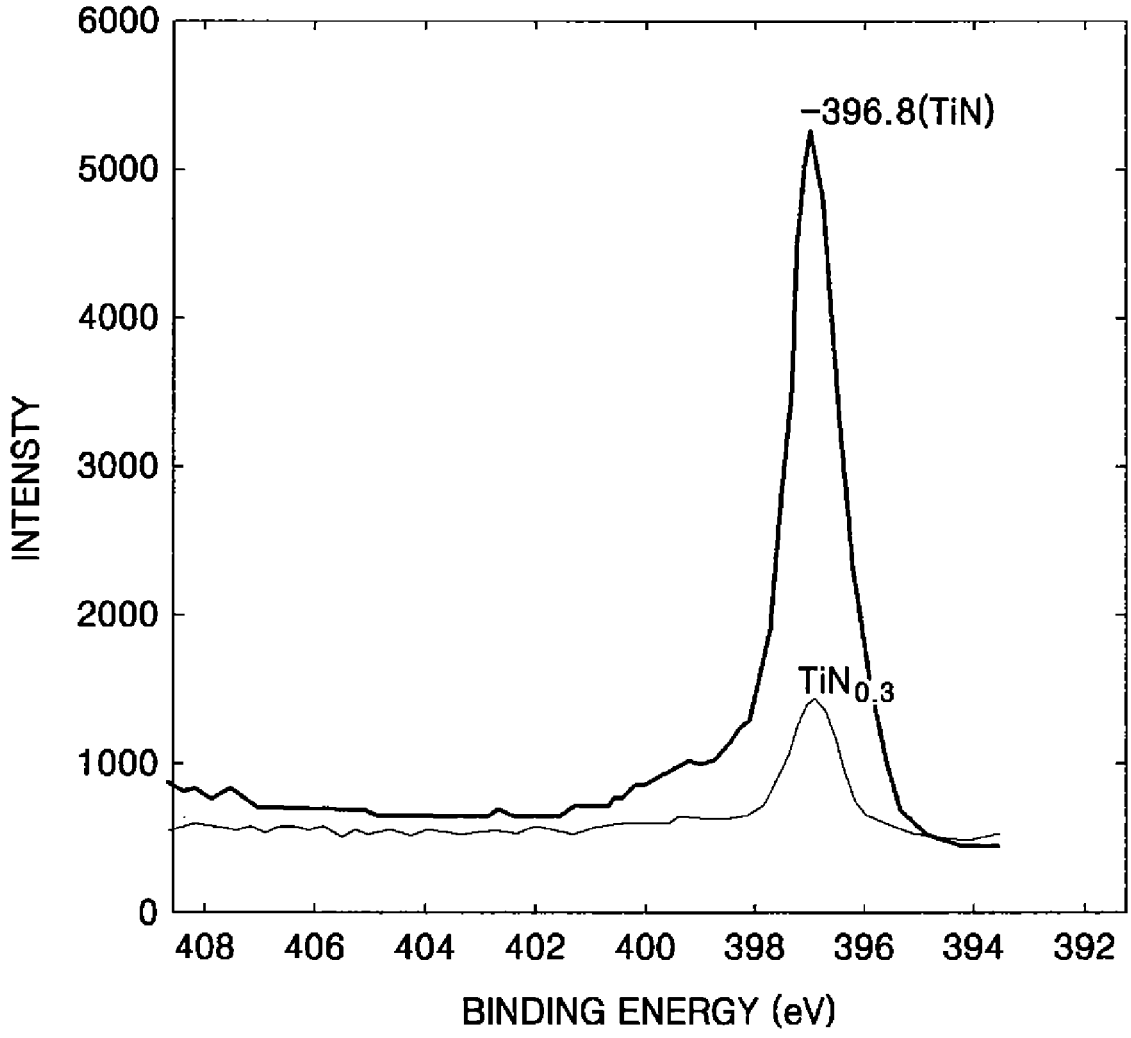
Figure 5:
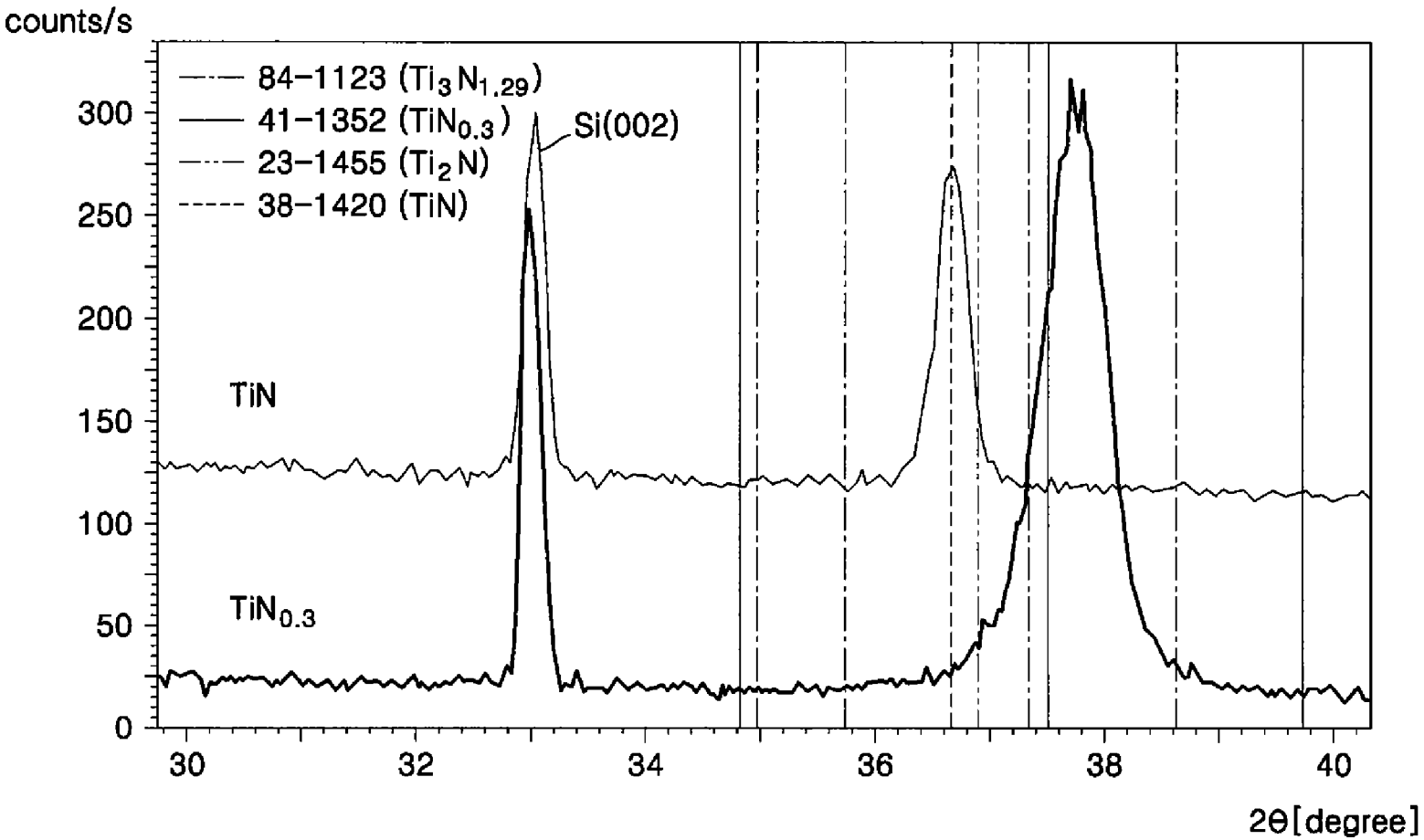
FIG. 5 illustrates the result of analyzing crystalline structures of the heat generating resistors made of $TiN_{0.3}$ and TiN using X-ray diffraction (XRD)

| Item | $TiN_{0.3}$ | TiN | Remarks |
|---|---|---|---|
| Specific-resistance [μΩcm] | 400 | 300 | |
| Composition | Ti:N = 1:0.2 | Ti:N = 1:0.99 | Refer to FIG. 4 |
| Crystalline structure | hexagonal [α-$TiN_{0.3}$] | Face-centered cubic [NaCl type of structure] | Refer to FIG. 5 |

Heat generating resistors made of $TiN_{0.3}$ and TiN materials from $TiN_x$ compounds have been selected by measuring resistances of the heat generating resistors with respect to an applied input energy in a thermal step stress test (SST) that applies input energies that increase with a predetermined energy step, and the life spans have been measured in number of ejected ink dots until the heat generating resistors break down. Composition ratios and crystalline structures of the $TiN_{0.3}$ and TiN materials are then analyzed. Other titanium nitride compounds $TiN_x$ with x in a range of 0.2 to 0.5 have physical features similar to $TiN_{0.3}$ and may also be used to manufacture the heat generating resistors.

Figure 2A:
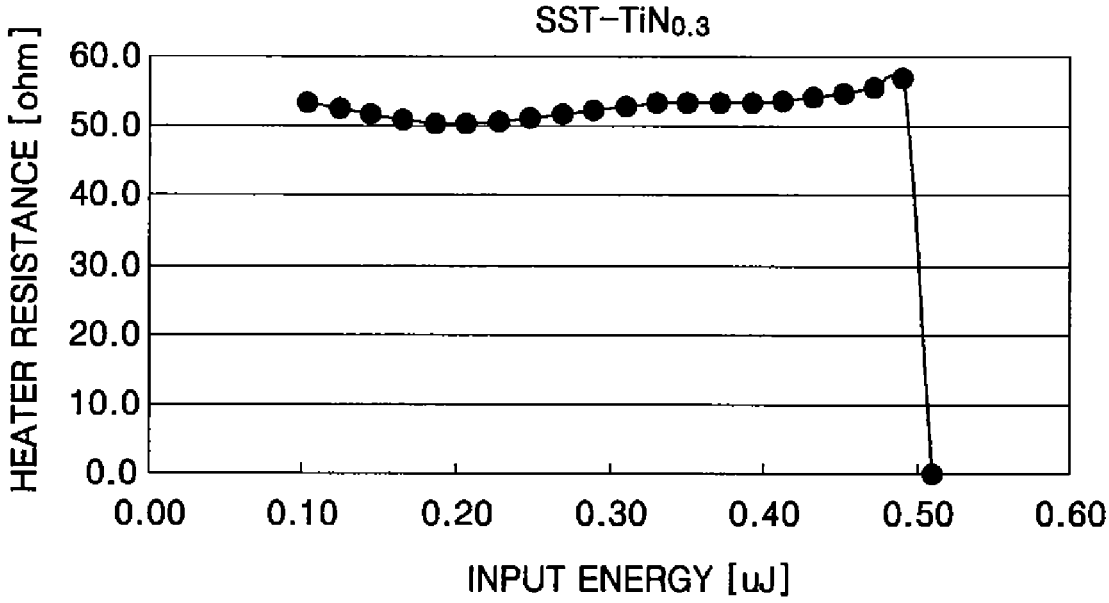
FIGS. 2A and 2B are graphs illustrating resistance of heat generating resistors made of $TiN_{0.3}$ and TiN, respectively, with respect to an applied input energy in a thermal step stress test (SST)
Figure 2B:
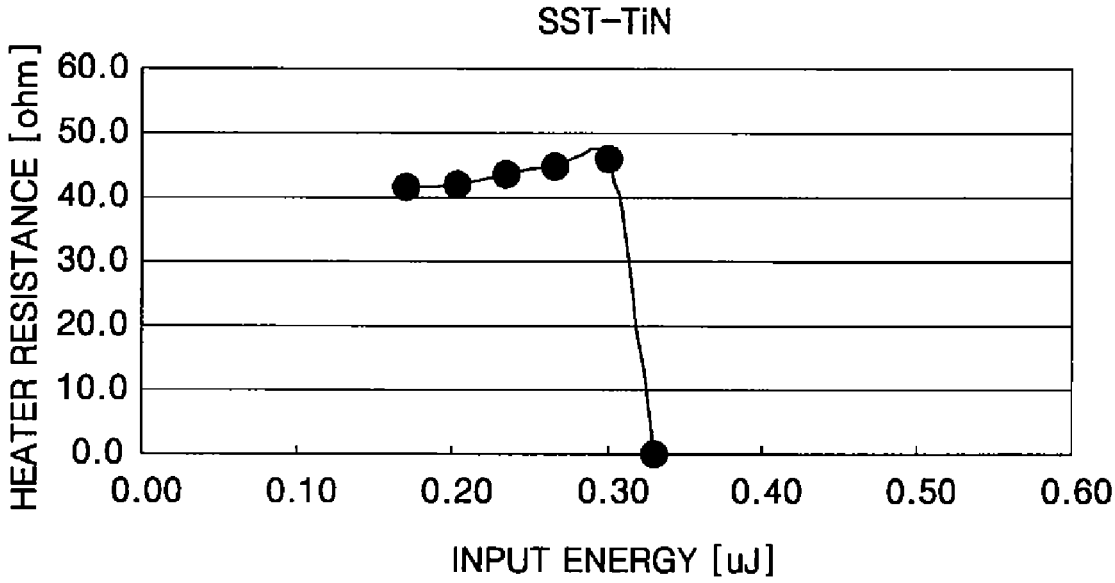

First, FIGS. 2A and 2B are graphs illustrating resistances of heat generating resistors made of $TiN_{0.3}$ and TiN, respectively, with respect to the thermal step stress test.

FIG. 2A illustrates the result of the thermal step stress test (SST) for the heat generating resistor made of $TiN_{0.3}$. According to the graph, by monitoring the variation in resistance of the heat generating resistor while increasing the input energy to the heat generating resistor, it can be observed that even though the input energy applied to the heat generating resistor made of $TiN_{0.3}$ increases from 0.10 μJ to nearly 0.50 μJ, the resistance remains around 54Ω, with little variation. This indicates that the heat generating resistor made of $TiN_{0.3}$ is resistant to thermal stress. Damage occurs when the input energy applied to the heat generating resistor made of $TiN_{0.3}$ exceeds 0.49 μJ.

Referring to FIG. 2B, the resistance of the heat generating resistor made of TiN increases from 41Ω as the input energy increases, and damage occurs when the input energy exceeds 0.27 μJ.

Therefore, the above described measurements prove that the heat generating resistor made of $TiN_{0.3}$ is more resistant to the thermal stress caused by the input energy increase compared to the heat generating resistor made of TiN.

Figure 3A:
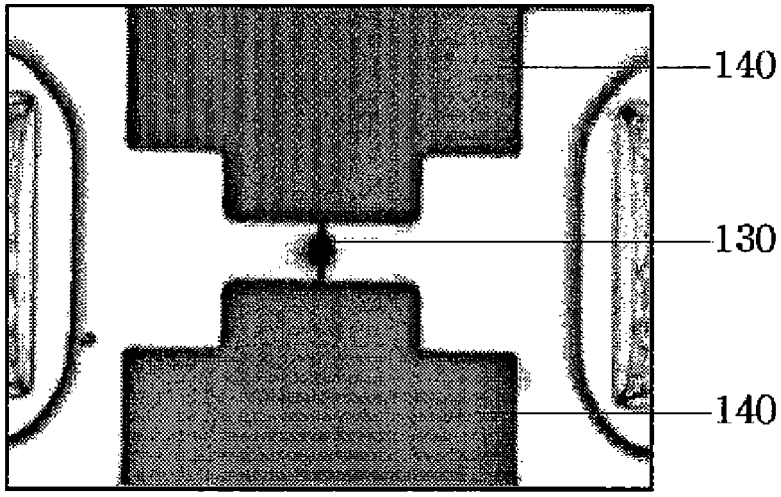
FIGS. 3A and 3B are views of broken heat generating resistors.
Figure 3B:
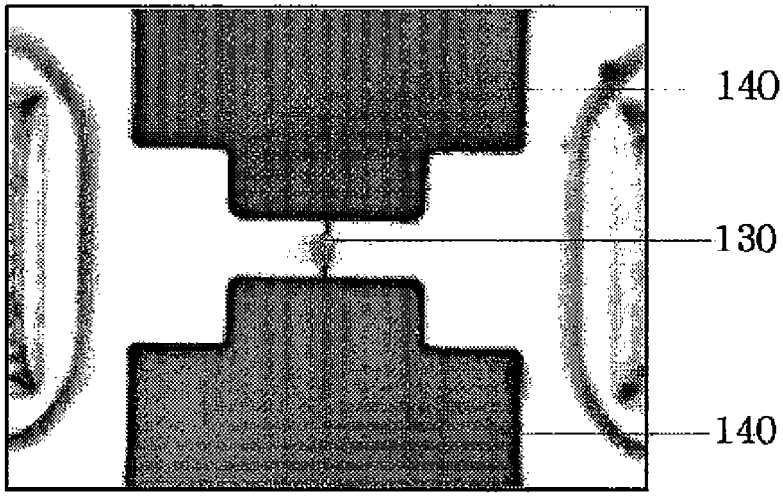

FIGS. 3A and 3B illustrate broken heat generating resistors made of $TiN_{0.3}$, respectively.

Referring to FIGS. 3A and 3B, the life span of the heat generating resistor made of $TiN_{0.3}$ is above five hundred million ink dots (5.64E+8, refer to Table 1), yet the life span of the heat generating resistor made of TiN could not be measured due to the damage that occurs as soon as it is connected to electrical power. Damage to the heat generating resistor made of $TiN_{0.3}$ normally occurs due to a cavitation force.

X-ray Photoelectron Spectroscopy (XPS) and X-ray diffraction (XRD) can be used (as illustrated in FIGS. 4A, 4B and 5) to analyze composition ratios and crystalline structures of the heat generating resistors used in the measurements described above.

FIGS. 4A and 4B are graphs illustrating results of analysing the heat generating resistors using XPS, and FIG. 5 is a graph illustrating result of analysing the heat generating resistors using XRD.

Referring to FIGS. 4A and 4B, the thin line represents $TiN_{0.3}$, and the thick line represents TiN. $TiN_{0.3}$ has a similar amount of Ti as TiN, but the content of N differs. Regarding the composition ratio of Ti to N according to the analysis result, the composition ratio of Ti to N in TiN is 1:0.99, and the composition ratio of Ti to N in $TiN_{0.3}$ is 1:0.2.

Referring to FIG. 5, which illustrates the result of the XRD analysis, the measured crystalline structure angles 2θ indicate that TiN has a face-centered cubic structure, like NaCl, and $TiN_{0.3}$ has a hexagonal lattice structure with an $\alpha$-$TiN_{0.3}$ structure.

Figure 6:
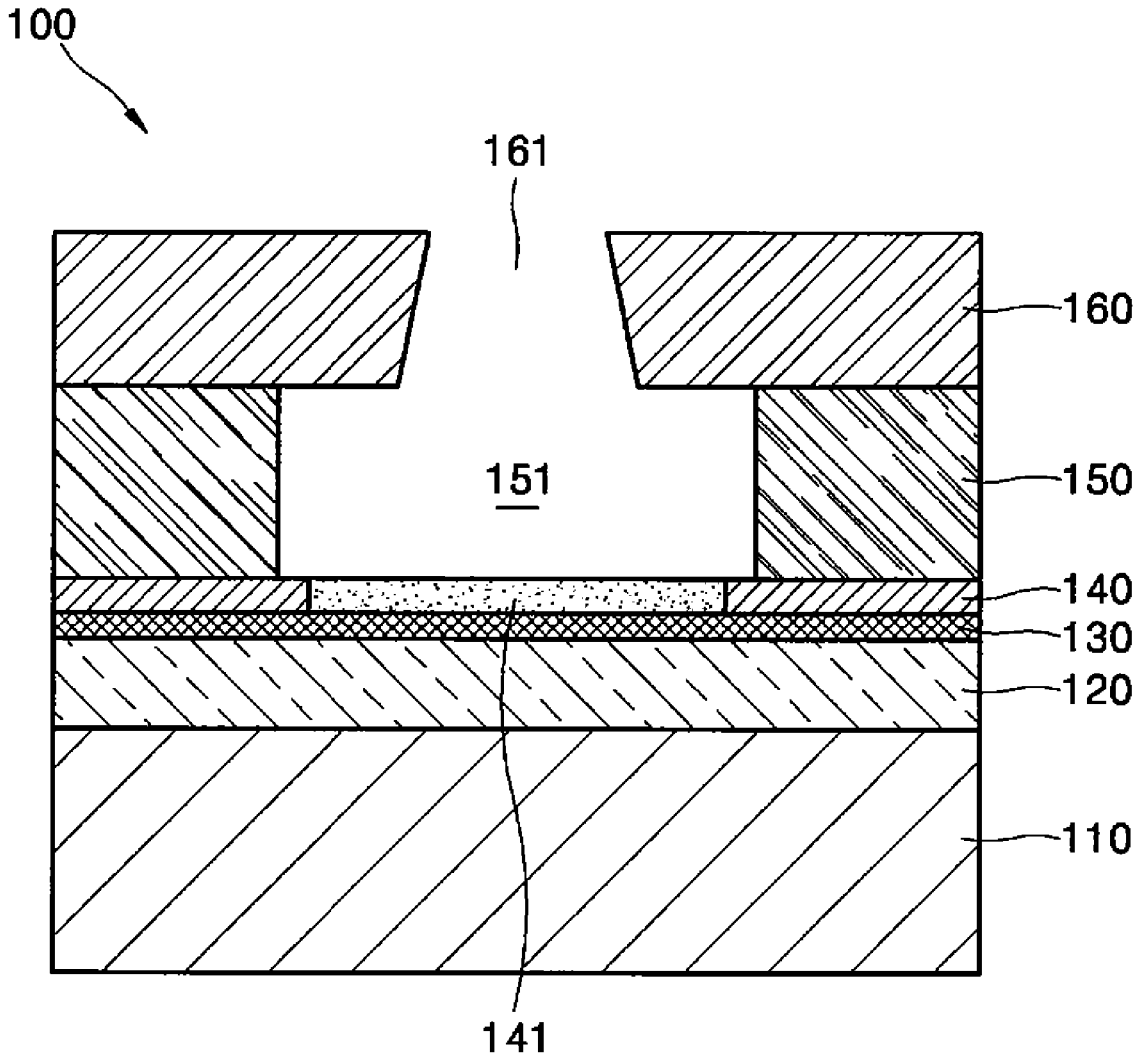
FIG. 6 is a cross-sectional view illustrating a structure of an inkjet printhead, which further includes an isolating layer on the heat generating resistor according to an embodiment of the present general inventive concept.

FIG. 6 is a cross-sectional view illustrating a structure of an inkjet printhead similar to the inkjet printhead of the embodiment of FIG. 1, but further including an isolating layer 141 on the heat generating resistor 130, according to another embodiment of the present general inventive concept. In FIG. 6, same reference numerals denote the same elements having the same functions as in FIG. 1. Referring to FIG. 6, the isolating layer 141 is formed on the heat generating resistor 130, and thus the heat generating resistor 130 is separated from ink (not shown) which fills the ink chamber 151. The isolating layer 141 may be formed of a material selected from a group consisting of $SiO_x$, $SiN_x$ and $AlO_x$. The isolating layer 141 may be selectively applied.

As described above, the inkjet printheads according to various embodiments of the present general inventive concept have a heat generating resistor with an excellent heating capability and is made of $TiN_x$, where x is within a predetermined range, enables low power and high efficiency driving, and accomplishes high nozzle density due to a low voltage demand, a longer life span of the printhead, and increased reliability.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead, comprising:

a substrate having an ink chamber which is filled with ink to be ejected;

a nozzle plate formed on the substrate in a position corresponding to the ink chamber; and a heat generating resistor formed in the ink chamber to generate bubbles in the ink by providing heat, the heat generating resistor being formed of titanium nitride $TiN_x$, where x ranges from 0.2 to 0.5.

2. The inkjet printhead of claim 1, wherein the heat generating resistor is formed of $TiN_{0.3}$.

3. The inkjet printhead of claim 2, wherein the heat generating resistor has a hexagonal crystalline structure.

4. The inkjet printhead of claim 2, wherein a specific resistance of the heat generating resistor is in a range of approximately 400 μΩ cm to 500 μΩ cm.

5. The inkjet printhead of claim 1, wherein a specific resistance of the heat generating resistor is in a range of approximately 400 μΩ cm to 500 μΩ cm.

6. The inkjet printhead of claim 2, wherein a thickness of the heat generating resistor is in a range of approximately 500 Å to 5000 Å.

7. The inkjet printhead of claim 1, wherein a thickness of the heat generating resistor is in a range of approximately 500 Å to 5000 Å.

8. The inkjet printhead of claim 2, further comprising:

an isolating layer formed of one selected from a group consisting of $SiO_x$, $SiN_x$ and $AlO_x$ to suppress a reaction of the heat generating resistor in contact with the ink.

9. The inkjet printhead of claim 1, further comprising:

an isolating layer formed of one selected from a group consisting of $SiO_x$, $SiN_x$ and $AlO_x$ to suppress a reaction of the heat generating resistor in contact with the ink.

10. An inkjet printhead, comprising:

a substrate;

a nozzle plate having a plurality of nozzles to eject ink; and a plurality of nozzle units formed between the substrate and the nozzle plate corresponding to the plurality of nozzles, each of the plurality of nozzle units including:

an ink chamber filled with ink to be ejected through the corresponding nozzle from the plurality of nozzles; and a heat generating resistor disposed in the ink chamber opposite to the nozzle to heat the ink when connected to a power supply, the heat generating resistor being made of $TiN_x$, where x is in a range of between 0.2 and 0.5.

11. The inkjet printhead of claim 10, further comprising:

a substrate isolating layer to isolate the substrate from the heat generating resistor.

12. The inkjet printhead of claim 10, further comprising:

a driving unit to drive the power supply to selectively supply power to the heat generating resistor of each of the plurality of nozzle units.

13. The inkjet printhead of claim 10, further comprising:

a plurality of barriers formed on the substrate to surround the ink chamber of each of the plurality of nozzle units.

14. The inkjet printhead of claim 10, further comprising:

an isolating layer formed on the heat generating resistor to separate the heat generating resistor from the ink that fills the ink chamber.

15. The inkjet printhead of claim 14, wherein the isolating layer is made of a material selected from a group consisting of $SiO_x$, $SiN_x$ and $AlO_x$.

16. The inkjet printhead of claim 10, wherein the plurality of nozzles are arranged in at least one line corresponding to a width of a recording medium.

17. The inkjet printhead of claim 10, wherein a thickness of the heat generating resistor is in a range of approximately 500 Å to 5000 Å.

18. The inkjet printhead of claim 10, wherein a specific resistance of the heat generating resistor is in a range of approximately 400 μΩ cm to 500 μΩ cm.

19. The inkjet printhead of claim 10, wherein the heat generating resistor is in direct contact with the ink in the ink chamber.

20. A method of ejecting ink through nozzles of an inkjet printhead, the method comprising:

heating ink in a chamber above a boiling temperature using heat generating resistors corresponding to each of the nozzles, the heat generating resistors being made of a $TiN_x$ compound, where x is between 0.2 and 0.5.

* * * * *